United States Patent [19]

Sugiura

[11] Patent Number: 4,972,813

[45] Date of Patent: Nov. 27, 1990

[54] CYLINDER HEAD AND CAMSHAFT ARRANGEMENT FOR INTERNAL COMBUSTION ENGINE

[75] Inventor: Yoshiaki Sugiura, Iwata, Japan

[73] Assignee: Yamaha Hatsudoki Kabushiki Kaisha, Iwata, Japan

[21] Appl. No.: 447,631

[22] Filed: Dec. 8, 1989

[30] Foreign Application Priority Data

Dec. 9, 1988 [JP] Japan ..... 63-312354

[51] Int. Cl.[5] ..... F02F 1/00

[52] U.S. Cl. ..... 123/193 H; 123/193 CH

[58] Field of Search ..... 123/193 CH, 193 H, 90.27, 123/41.82 R

[56] References Cited

U.S. PATENT DOCUMENTS 2,736,300 2/1956 Flynn ..... 123/193 CH 4,621,597 11/1986 Kawada et al. ..... 123/193 H

FOREIGN PATENT DOCUMENTS 0000653 1/1987 Japan ..... 123/193 CH

*Primary Examiner*—Andrew M. Dolinar

*Assistant Examiner*—M. Macy

*Attorney, Agent, or Firm*—Ernest A. Beutler

[57] ABSTRACT

A cylinder head arrangement for an internal combustion engine wherein the cylinder head has a generally I-shape and cross section so as to permit attachment of the cylinder head to the cylinder block without necessitating removal of any of the components of the cylinder head assembly or opening or accessing the valve train.

10 Claims, 2 Drawing Sheets

CYLINDER HEAD AND CAMSHAFT ARRANGEMENT FOR INTERNAL COMBUSTION ENGINE

BACKGROUND OF THE INVENTION

This invention relates to a cylinder head and camshaft arrangement for an internal combustion engine and more particularly to an improved cylinder head construction and arrangement for attaching it to a cylinder block.

As is well known, the performance of an internal combustion engine can be improved by using overhead valves and direct valve actuation by overhead mounted camshafts. In many high performance engines, multiple intake and exhaust valves and multiple camshafts are also employed. Although such constructions increase the performance of the engine, they also complicate significantly the construction of the cylinder head and particularly the manner by which it may be attached to the cylinder block. It is, of course, extremely important to insure that the clamping of the cylinder head to the cylinder block is uniform around the cylinder bore so as to insure against gasket failures and leakage. However, this problem becomes particularly acute when overhead camshafts are employed. That is, the placement of the hold down fasteners for the cylinder head can be comprised due to the use of the overhead camshafts.

In addition to the aforenoted problems, when overhead camshafts are employed it is frequently the practice to place the fasteners for the cylinder head to the cylinder block within the cam cover of the engine. This means that the cam cover must be removed to access the fasteners. In addition, frequently it becomes necessary to remove some of the valve train in order to access the fastener. In addition to the increased labor caused by such assembly methods, there is also the danger that when servicing the cylinder head fasteners that foreign material may enter into the valve train and cause eventual damage or wear. Since frequently it is the practice to require retorquing of the cylinder heads after a certain amount of running following rebuilds, the problems are not insignificant.

It is, therefore, a principal object of this invention to provide an improved overhead valve arrangement and system for fastening a cylinder head to the cylinder block.

It is a further object of this invention to provide a cylinder head construction that permits the cylinder head to be attached to the block without necessitating removal of any components of the valve train or with necessitating accessing the fasteners through the valve cover.

It is a further object of this invention to provide an improved overhead camshaft cylinder head assembly wherein the camshaft can be assembled and disassembled from the engine externally of the cylinder head and without requiring removal of any of the cylinder head assembly components

SUMMARY OF THE INVENTION

This invention is adapted to be embodied in a cylinder head assembly for use with a cylinder block having at least one cylinder bore opening through an upper face thereof. The cylinder head assembly has a lower portion defining a surface that is adapted to form a seal with the cylinder head upper face and close the cylinder bore. A valve train is carried by the cylinder head assembly for controlling the flow of a charge between the cylinder bore and the atmosphere and includes actuating means carried by an upper portion of the cylinder head which is disposed at least in part outwardly of the cylinder bore. An intermediate portion of the cylinder head integrally connects the upper and lower portions and is narrower than these portions so that the cylinder head has an I shaped configuration. Threaded fastening means cooperate with the cylinder head lower portion for affixing the cylinder head to the cylinder block on opposite sides of the cylinder bore. The threaded fastening means are accessible through an area outwardly of the intermediate portions for removal of the threaded fastening means without removal of any component of the valve train or cylinder head assembly.

DETAILED DESCRIPTION OF THE PREFERRED EMBODIMENT OF THE INVENTION

Figure 1:
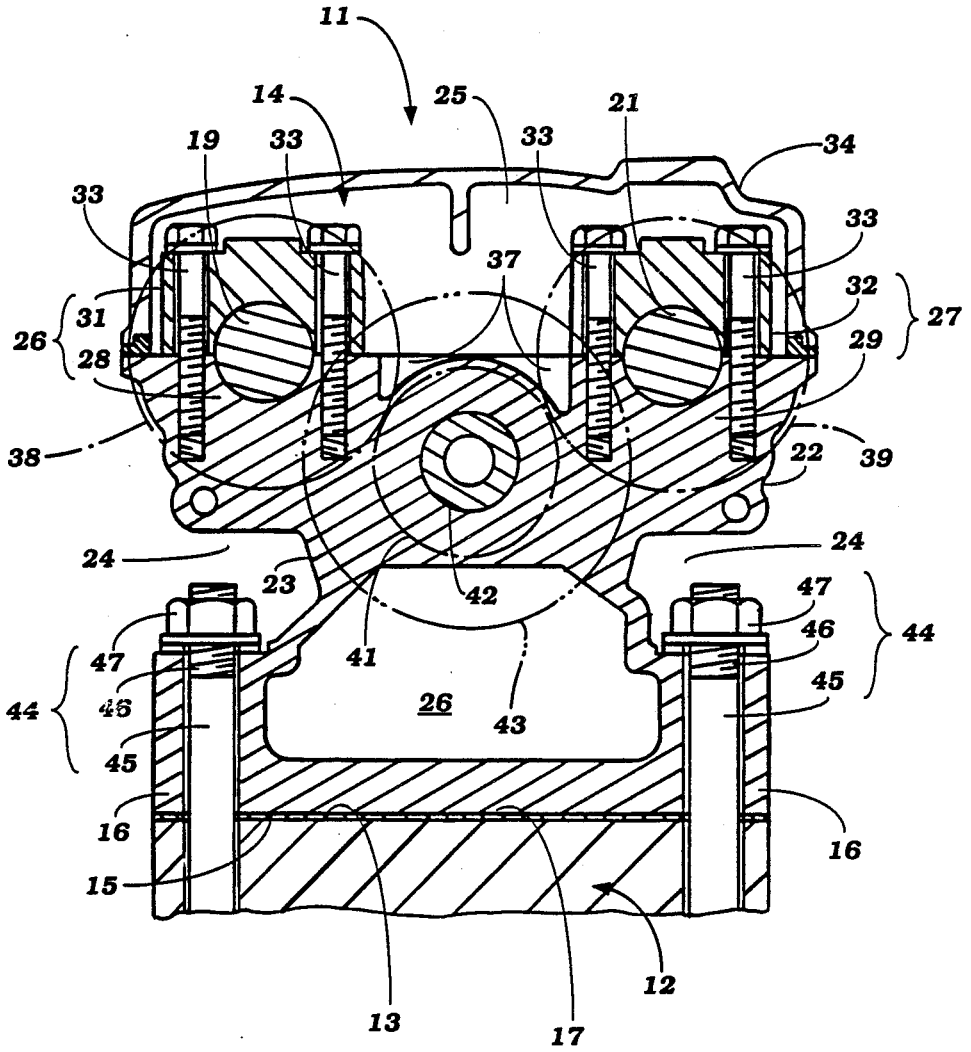
FIG. 1 is a partial cross sectional view taken through an internal combustion engine constructed in accordance with an embodiment of this invention and generally along the line 1—1 of FIG. 2.
Figure 2:
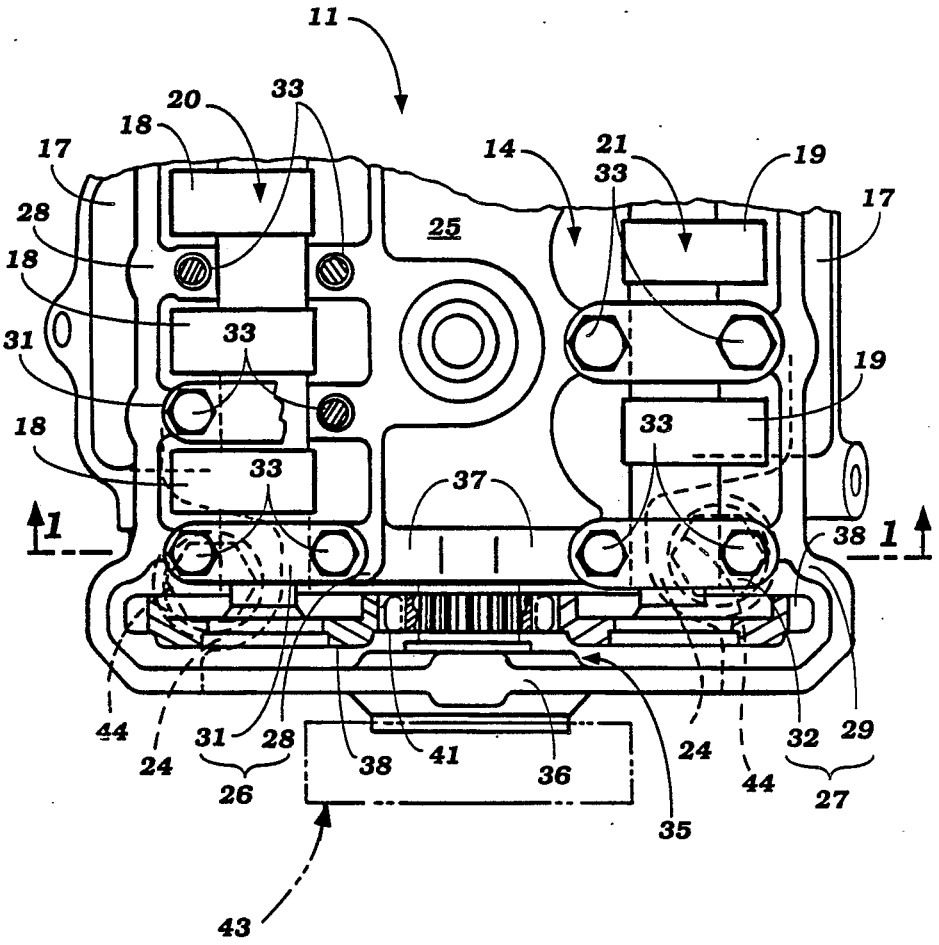
FIG. 2 is a top plan view of the cylinder head assembly with the cam cover removed.

In the drawings the reference numeral 11 indicates generally an internal combustion engine constructed in accordance with an embodiment of the invention. Since the invention relates primarily to the cylinder head assembly in the manner in which it is affixed to the block, only this portion of the engine has been illustrated. In all other regards, it may be assumed that the engine 11 is of a conventional type. Also, the invention is depicted in conjunction with a portion of one cylinder of an in-line type of engine. It is to be understood, however, that the invention has utility with cylinder heads for engines other than in-line type engines and for engines having any number of cylinders.

The cylinder block is identified generally by the reference numeral 12 and is formed with a plurality of longitudinally spaced cylinder bores (not shown) which open through an upper face 13 of the cylinder block 12. A cylinder head assembly, indicated generally by the reference numeral 14 is affixed, in a manner to be described, with a lower face 15 of a lower portion thereof 16 in sealing engagement with a gasket 17 that is interposed between the cylinder block 12 in the cylinder head 14 for sealing purposes. The lower face 15 of the cylinder head portion 16 may also be formed with recesses which cooperate with the cylinder bores and pistons that reciprocate therein to form the combustion chambers of the engine. Poppet type intake and exhaust valves (not shown) control the flow of gases to and from these combustion chambers through suitable intake and exhaust ports which have repective openings 17 in opposite sides of the cylinder head 14. There may be either one intake valve and one exhaust valve for each cylinder bore or multiple valves as desired.

These valves are operated by lobes 18 and 19 formed on camshafts 20 and 21, respectively These camshafts 20 and 21 are journalled in an upper portion 22 of the cylinder head assembly 14 in a manner to be described. It should be noted that the upper portion 22 is integrally connected to the lower portion 16 by an intermediate portion 23 which has a smaller width in the cross section shown in FIG. 1 than the upper and lower portions 22 and 16 respectively. This gives rise to a generally I-shaped configuration for the cylinder head assembly and provides recesses 24 that are positioned beneath the camshafts 20 and 21 for a purpose to be described.

The cylinder head upper portion 22 is formed with a generally concave recess 25 in which the valve actuating mechanism comprised of the camshafts 20 and 21 is contained. Respective bearing portions 26 and 27 formed in this recess 25 journal the camshafts 19 and 21, respectively. Each bearing portion 26 and 27 is comprised of a respective lower bearing surface 28 and 29 which is formed directly in the cylinder head material and thus forms half of the bearings for the camshafts 20 and 21. A plurality of space bearing caps 31 and 32, respectively, are affixed over the cylinder head bearing portions 28 and 29 by threaded fasteners such a bolts 33 or stud and nut assemblies.

The chamber 25 in which the valve actuating mechanism described is contained is covered by means of a cover plate 34 that is affixed to the cylinder head 14 in a suitable manner.

At the forward end of the cylinder head 14 there is provided a recess 35 that is defined by an upstanding front wall 36. This recess is defined on its rear side by an upstanding wall 37 and contains the mechanism for driving the camshafts 20 and 21 in a timed relationship. This mechanism includes a pair of timing gears 38 and 39 which are affixed to the camshafts 20 and 21 in a known manner. These timing gears 38 and 39 are enmeshed with a further gear 41 which is journalled on a shaft 42 that extends through the front wall 36 of the cylinder head 14. It should be noted that the ratio between the gear 41 and the gears 38 and 39 may be either one to one or a ratio other than one to one so as to achieve the desired timing relationship between the crankshaft and the camshafts 20 and 21 so that the camshafts 20 and 21 rotate at one half of crankshaft speed, as is well known.

A timing pulley or sprocket 43 is affixed to the front end of the shaft 42 and is driven from the crankshaft either by a belt or chain as desired. The ratio between the crankshaft and the pulley or sprocket 43 coupled with the ratio between the gear 41 and the gears 38 and 39 will obtain the aforenoted drive ratio between the crankshaft and the camshafts 20 and 21.

The cylinder head 14 is affixed to the cylinder block 12 by means of a plurality of fastener assemblies 44 which, as have been aforenoted, are positioned so to be accessible through the recesses 24 and thus permit removal or insertion of the head 14 from or on the cylinder block 12 without necessitating removal of any of the components of the head assembly or even removal of the cam cover 34. The fastener assembly depicted is of the stud type and includes studs 45 that are affixed to the cylinder block 12 in a known manner and have threaded upper portions 46 on which nuts 47 are received. The nuts 47 may be easily tightened and removed from the recessed areas 24 and thus the cylinder head assembly 14 can be removed as a unit as aforenoted. It should be understood that bolts rather than studs and nuts may be utilized for the fasteners 44, but the use of studs and nuts permits easier assembly and disassembly, as should be readily apparent.

In defining the cylinder head upper and lower portions in both the Specification and claims hereof the term "upper" is used to refer to the portion of the cylinder head more remote from the cylinder block while the term "lower" is intended to refer to the portion adjacent the cylinder block. Thus, the terms "upper" and "lower" are used only by reference to the associated cylinder block and not to the actual orientation of the cylinder head in space. Obviously if the cylinder block is inverted, then the upper portion of the cylinder head would actually be the lower portion and vice versa. However, the terms "upper" and "lower" are used by the reference as aforenoted to the relationship to the cylinder block rather than to the actual spatial relationship which is dependent upon how the engine is installed.

As will become obvious to those skilled in the art, the aforedescribed construction provides a very compact cylinder head assembly and nevertheless one that can be easily serviced by installation and removal without requiring the removal of any components of the head assembly or accessing the valve actuating mechanism. The foregoing is, of course, only a description of a preferred embodiment of the invention and various changes and modifications may be made without departing from the spirit and scope of the invention, as defined by the appended claims.

I claim:

1. A cylinder head arrangement for use with a cylinder block having at least one cylinder bore opening through an upper face thereof, said cylinder head having a lower portion defining a first surface adapted to form a seal with the cylinder block upper face and closing the cylinder bore, a valve train carried by said cylinder head for controlling the flow of a charge between the cylinder bore and the atmosphere, said valve train including actuating means carried by an upper portion of said cylinder head and disposed at least in part outwardly of the cylinder bore, an intermediate portion of said cylinder head integrally connecting said upper and lower portions, said intermediate portion being narrower than said upper and lower portions so that said cylinder head has an I-shaped configuration, and threaded fastening means cooperating with said cylinder head lower portion for affixing said cylinder head to the cylinder block on opposite sides of the cylinder bore, said threaded fastening means being accessible through the area outwardly of said intermediate portion for removal of said fastening means without removal of any component of said valve train or the cylinder head assembly.

2. A cylinder head arrangement as set forth in claim 1 wherein the actuating means comprises a pair of camshafts journaled on opposite sides of the cylinder bore.

3. A cylinder head arrangement as set forth in claim 2 wherein the camshafts are journaled at least in part in the cylinder head.

4. A cylinder head arrangement as set forth in claim 3 wherein there is further provided a cam cover for enclosing the area of the cylinder head where the camshafts are journaled and which need not be removed to remove the threaded fastening means.

5. A cylinder head arrangement as set forth in claim 1 wherein the valve train includes a plurality of poppet valves supported for reciprocation within the cylinder head.

6. A cylinder head arrangement as set forth in claim 5 wherein the actuating means comprises a pair of camshafts journaled on opposite sides of the cylinder bore.

7. A cylinder head arrangement as set forth in claim 6 wherein the camshafts are journaled at least in part in the cylinder head.

8. A cylinder head arrangement as set forth in claim 7 wherein there is further provided a cam cover for enclosing the area of the cylinder head where the camshafts are journaled and which need not be removed to remove the threaded fastening means.

9. A cylinder head arrangement as set forth in claim 1 wherein the threaded fastening means comprise studs affixed to the cylinder block and nuts bearing against the cylinder head lower portion.

10. A cylinder head arrangement as set forth in claim 2 further including timing gear means affixed to the camshafts and meshingly engaged with a timing gear journaled in the cylinder head and driven from the crankshaft of the engine for driving the camshafts.

* * * * *